US011798757B1

(12) United States Patent
Malawiya et al.

(10) Patent No.: US 11,798,757 B1
(45) Date of Patent: Oct. 24, 2023

(54) BUTTON COVER

(71) Applicant: MZ SERVICES LTD., Vancouver (CA)

(72) Inventors: Iftikar Malawiya, Vancouver (CA); Brandon Zdrilic, Coquitlam (CA)

(73) Assignee: MZ Services Ltd., Vancouver (CA)

( * ) Notice: Subject to any disclaimer, the term of this patent is extended or adjusted under 35 U.S.C. 154(b) by 0 days.

(21) Appl. No.: 18/093,641

(22) Filed: Jan. 5, 2023

Related U.S. Application Data

(63) Continuation of application No. PCT/CA2021/050966, filed on Jul. 13, 2021.

(60) Provisional application No. 63/051,353, filed on Jul. 13, 2020.

(51) Int. Cl.
*H01H 13/04* (2006.01)
*H01H 13/86* (2006.01)
*H01H 3/12* (2006.01)

(52) U.S. Cl.
CPC ..... *H01H 13/04* (2013.01); *H01H 3/12* (2013.01); *H01H 13/86* (2013.01)

(58) Field of Classification Search
CPC ..... H01H 13/04; H01H 3/12; H01H 13/86; H01H 3/125; H01H 13/705; H01H 13/14; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 13/20; H01H 2239/03; H01H 2300/024; H01H 2217/008; H01H 2221/068
See application file for complete search history.

(56) References Cited

U.S. PATENT DOCUMENTS

2011/0214976 A1* 9/2011 Bloch ..... H01H 13/06 200/302.2
2011/0259725 A1* 10/2011 Giordano ..... B66D 1/46 200/5 E

FOREIGN PATENT DOCUMENTS

CN 1452193 A 10/2003
CN 204130374 U 1/2015

OTHER PUBLICATIONS

International Search Report and Written Opinion dated Sep. 21, 2021 issued in the corresponding International Patent Application No. PCT/CA2021/050966.

* cited by examiner

*Primary Examiner* — Ahmed M Saeed
(74) *Attorney, Agent, or Firm* — McCarthy Tétrault LLP

(57) ABSTRACT

A safety button cover for use with a button station is provided. The safety button cover comprises a button cover sleeve with a first and second open end that define an interior space therebetween. A dividing wall is provided between the first and second open ends to separate the interior space into a first recess and second recess. The dividing wall further includes at least one opening to permit a corresponding button of the button station to extend from the first recess through the opening into the second recess. When the safety button cover is installed over the button station, a portion of the button cover sleeve surrounds a button panel and a portion of a button housing on which the button is installed to define an overlap region between the safety button cover and the button station.

17 Claims, 9 Drawing Sheets

BUTTON COVER

RELATED APPLICATIONS

This application is a continuation of PCT Application No. PCT/CA2021/050966 filed on Jul. 13, 2021, which This application claims priority from U.S. Provisional Patent Application No. 63/051,353, filed on Jul. 13, 2020 entitled "Button Cover", the entirety of which is hereby incorporated by reference. The entirety of the contents of the referenced applications are hereby incorporated by reference.

TECHNICAL FIELD

The present disclosure relates generally to devices that provide protection or coverage to buttons provided on a button panel, and more particularly to a cover or shield to prevent accidental actuation and/or damage to physical buttons and controls.

BACKGROUND

Mechanical systems are often controllable via a control panel comprising one or more push buttons as shown in the button station depicted in FIGS. 1A and 1B. These button stations may include emergency stop (E-Stop) buttons used for safety purposes and they are installed to a buttons station housing. These button stations may be found in industrial environments such as production lines and warehouses and are typically located close to higher traffic areas where people work in order to be effective. Consequently, these buttons are vulnerable to damage from accidental impact from various objects such as pushcarts and pallet jacks.

The E-stop buttons become damaged when they are struck with sufficient force and require servicing or replacement. This causes undesirable down time as the associated mechanical system must be powered down to ensure safety of the workers on the production line. Such downtime may lead to loss of productivity and therefore higher operating costs.

Existing button guards or shields are designed to prevent accidental or unintentional button actuation or activation. These covers are often designed to be held down by the button that for which shielding is desired. However, such guards or shields would not necessarily provide sufficient mechanical protection to prevent damage to the button. When the guard is damaged, it would damage the buttons in the process as well. Kick plates can be bolted around the button station housing to protect the buttons. However, this approach is not considered safe because it can be a major tripping hazard.

Accordingly, in view of the deficiencies identified, there is a need for an improved button cover that is suitable to provide the desired mechanical protection to prevent damage to the buttons.

SUMMARY OF THE DISCLOSURE

In general, the present specification describes a protective cover for use with a button station.

According to one aspect of the disclosure, there is provided a button cover comprising: a button cover sleeve with a first open end and a second open end that define an interior space therebetween; a dividing wall provided within the interior space between the first open end and the second open end to separate the interior space into a first recess and a second recess; and at least one opening defined on the dividing wall to permit a corresponding button of a button station to extend from the first recess through the opening into the second recess when the button cover is installed over the button station.

In some embodiments, a portion of the button cover sleeve corresponding to the first recess is shaped to surround a button panel and a corresponding portion of a button housing on which the button is installed to define an overlap region between the button cover and the button station when the button cover is installed over the button station.

In some embodiments, the portion of the button housing is received in the first recess and the button panel meets with the dividing wall.

In some embodiments, the button cover sleeve is configured to cause external forces applied against the button to be sustained by the button cover sleeve when the button cover sleeve is installed over the button station such that the external forces are redistributed away from the button to the button panel and the button housing via the overlap region.

In some embodiments, the dividing wall comprises a plurality of attachment holes for fastening the button cover to the button housing.

In some embodiments, the first recess has a first depth that is greater than a second depth of the second recess.

In some embodiments, the first recess has a first depth that is the same a second depth of the second recess.

In some embodiments, the first recess has a first depth that is less than a second depth of the second recess.

In some embodiments, first recess has a first depth of at least 0.75 inch or 19.05 mm.

In some embodiments, the second recess has a second depth that is at least a length of the button extending into the second recess.

In some embodiments, the button cover sleeve and dividing wall are fabricated using a rigid material.

In some embodiments, the rigid material is plastic.

In some embodiments, the button cover sleeve has a thickness from 1/16 inch and 1/4 inch or from 1.5875 mm to 6.35 mm.

In some embodiments, the dividing wall has a wall thickness from 1/8 inch and 1/4 inch or from 1.5875 mm to 6.35 mm.

In some embodiments, the button cover comprises a plurality of support ridges disposed within the second recess, each of the plurality of ridges extends from a corresponding position on the dividing wall and an internal surface of the button cover sleeve.

In some embodiments, each of the plurality of support ridges has a slope of having a rise:run ratio of 4:1.

In some embodiments, each of the plurality of support ridges has a ridge thickness from 1/16 inch and 1/4 inch from 1.5875 to 6.35 mm.

According to another aspect of the present disclosure, there is provided a button cover comprising: a button cover sleeve with a first open end and a second open end; a panel provided at the first open end of the button cover sleeve, the panel and the button cover sleeve define a recess; at least one opening defined on the panel to permit a button of the button station to extend through the opening when the button cover is installed over the button station; and a shield disposed around each of the at least one opening, the shield extending away from the recess.

In some embodiments, a portion of the button cover sleeve is shaped to surround a button panel and a corresponding portion of a button housing on which the button is installed when the button cover is installed over the button station to define an overlap region between the button cover and the button station.

In some embodiments, the portion of the button housing is received in the recess and the button panel meets with the panel.

In some embodiments, the button cover sleeve is configured to cause external forces applied against the button to be sustained by the button cover sleeve when the button cover is installed over the button station such that the external forces are redistributed away from the button to the button panel and the button housing via the overlap region.

In some embodiments, the panel comprises a plurality of attachment holes for fastening the button cover to the button housing.

In some embodiments, the button cover sleeve and panel are fabricated using a rigid material.

In some embodiments, the rigid material is plastic.

In some embodiments, the button cover sleeve has a thickness from 1/16 inch and 1/4 inch or from 1.5875 mm to 6.35 mm.

In some embodiments, the panel has a panel thickness from 1/16 inch and 1/4 inch or from 1.5875 mm to 6.35 mm.

In some embodiments, the shield has a length that is greater than or equal to the length of the button of the button station.

In some embodiments, the button cover comprises a pair of ribs, wherein each rib extends from a surface of the shield and the panel.

In some embodiments, the pair of ribs are positioned on a common plane parallel to a top surface of the button cover.

In some embodiments, each rib has a rib thickness from 1/16 inch and 1/4 inch or from 1.5875 mm to 6.35 mm.

Additional aspects of the present invention will be apparent in view of the description which follows.

BRIEF DESCRIPTION OF THE DRAWINGS

Features and advantages of the embodiments of the present invention will become apparent from the following detailed description, taken with reference to the appended drawings in which.

DETAILED DESCRIPTION

The description which follows and the embodiments described therein are provided by way of illustration of an example or examples of particular embodiments of the principles of the present invention. These examples are provided for the purposes of explanation and not limitation of those principles and of the invention. In some instances, certain structures and techniques have not been described or shown in detail in order not to obscure the invention.

A "button" as used in this application refers to any device used to activate and/or deactivate a system. While a button may have a circular shape, such as a small knob or disk, it can be of any shape suitable, including square, rectangular, hexagonal, or such other shapes that are suitable for use to activate and/or deactivate a system.

Figure 1B:
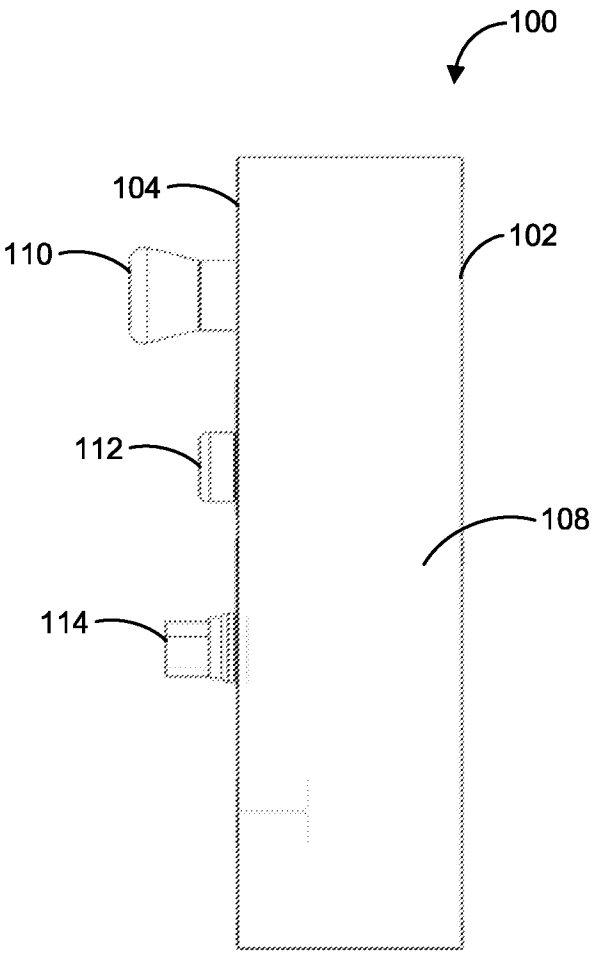
FIGS. 1A and 1B show a perspective view and a side view, respectively, of an example of a button station.
Figure 1A:
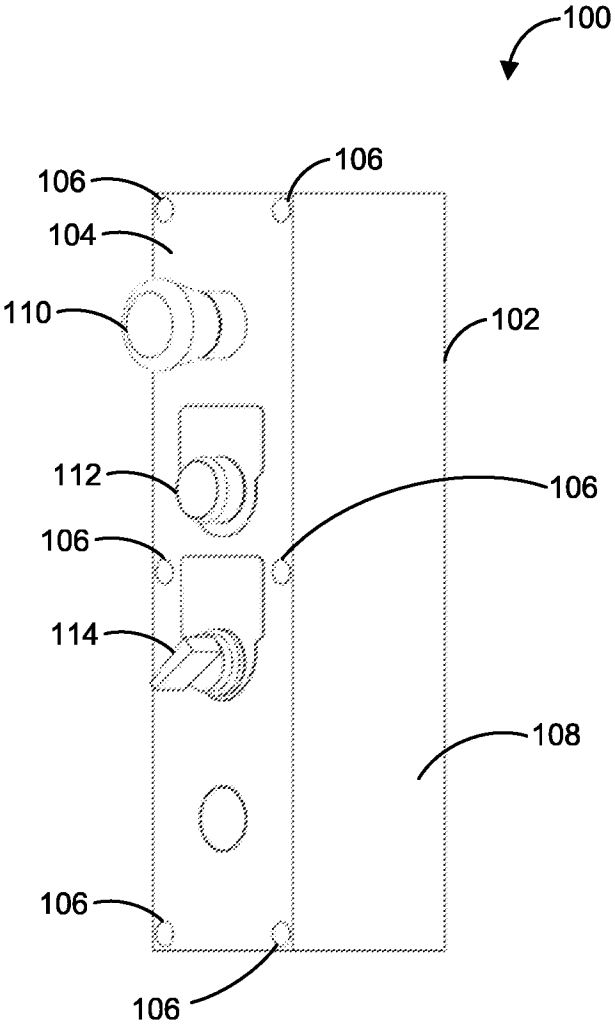

FIGS. 1A and 1B is a perspective view (FIG. 1A) and a side view (FIG. 1B) of an example of a button station 100. The button station 100 is a component of a control system operable to control the operation of a mechanical system within an industrial environment. For example, in a warehouse, a button station of the type shown in FIGS. 1A and 1B may be used to control a portion of a conveyor belt system.

In the example illustrated in FIG. 1, button station 100 includes a housing 102, which comprises a button panel 104 on which various buttons are installed, a rear panel (not shown), and sidewalls 108 positioned between the button panel 104 and the rear panel. The button panel 104 is removably coupled to the overall housing 102 to allow installation and wiring of the buttons within the button station 100. The button panel 104 includes a plurality of fastener holes 106 to receive fasteners to fasten the button panel 104 to the housing 102. In the illustrated embodiment, the housing 102 is generally rectangular in shape, which provides a rectangular shaped button panel 104. However, in other embodiments, the housing 102 and/or button panel 104 may have different shapes to suit the operating environment in which button station 100 is installed.

In the example illustrated in FIGS. 1A and 1B, the button station 100 comprises controls including an emergency stop (E-Stop) button 110, a push button 112, and a rotatable dial 114 (collectively referred to herein as the "controls"). In other embodiments, button station 100 comprises only some or a subset of the controls shown in FIGS. 1A and 1B. In general, button station 100 may include any suitable number and/or any suitable combination of the controls shown in FIGS. 1A and 1B. Such a button station 100 may be commonly found in industrial environments, such as production/assembly lines and warehouses and generally located close to higher pedestrian traffic areas to allow the controls to be accessible. The controls can be activated/engaged, for example, in case of an emergency to stop the operation of the production/assembly line. Consequently, these controls are vulnerable to damage from accidental impact from various objects such as pushcarts and pallet jacks.

Figure 2B:
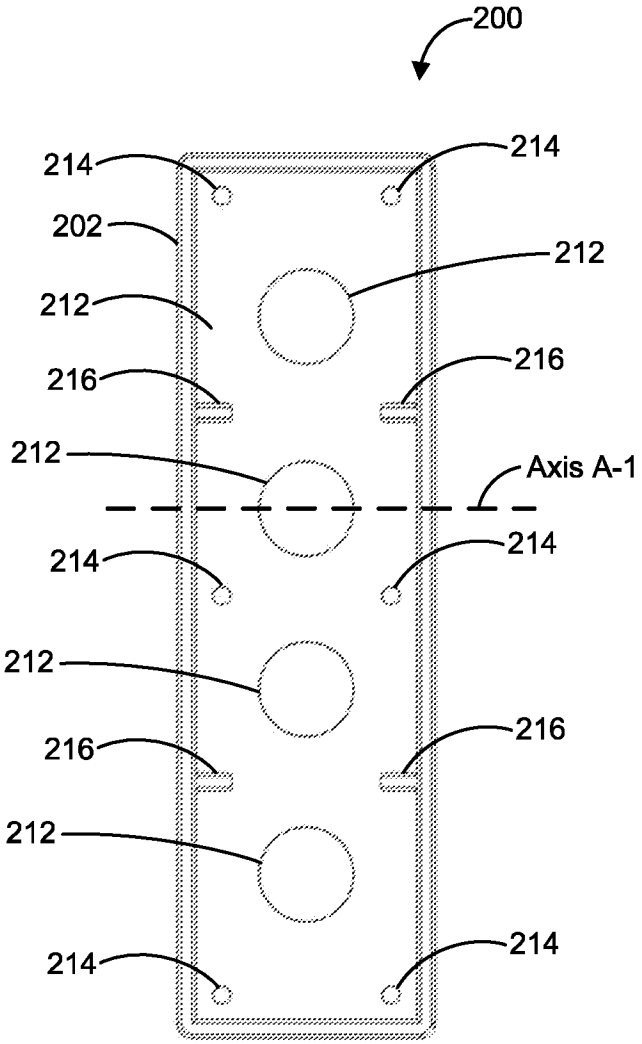
FIGS. 2A and 2B show a perspective view and a plan view, respectively, of a front portion of an embodiment of a button station cover for covering a button station of the type shown in FIGS. 1A and 1B.
Figure 2A:
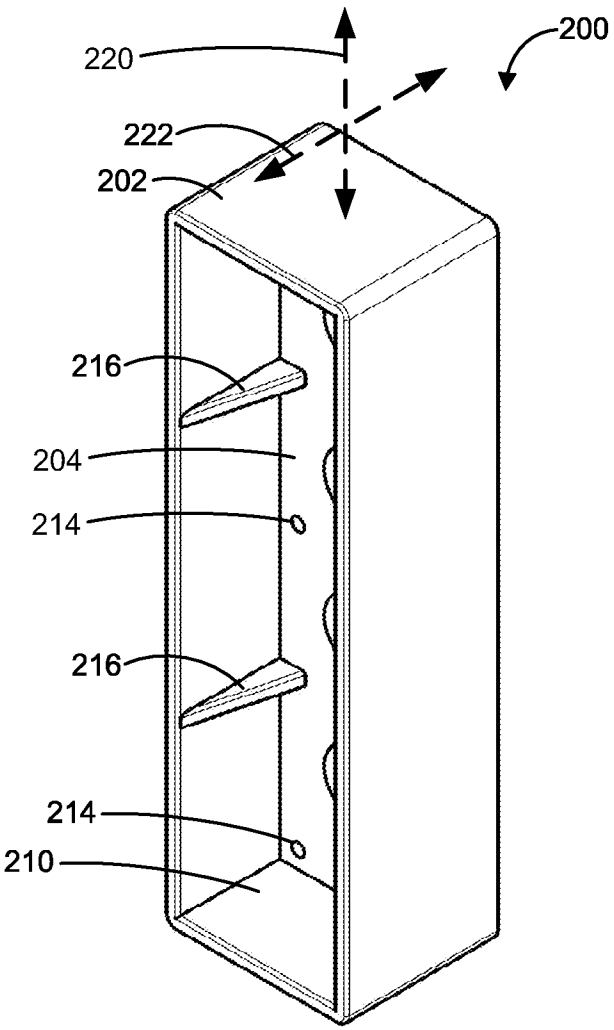
Figure 3B:
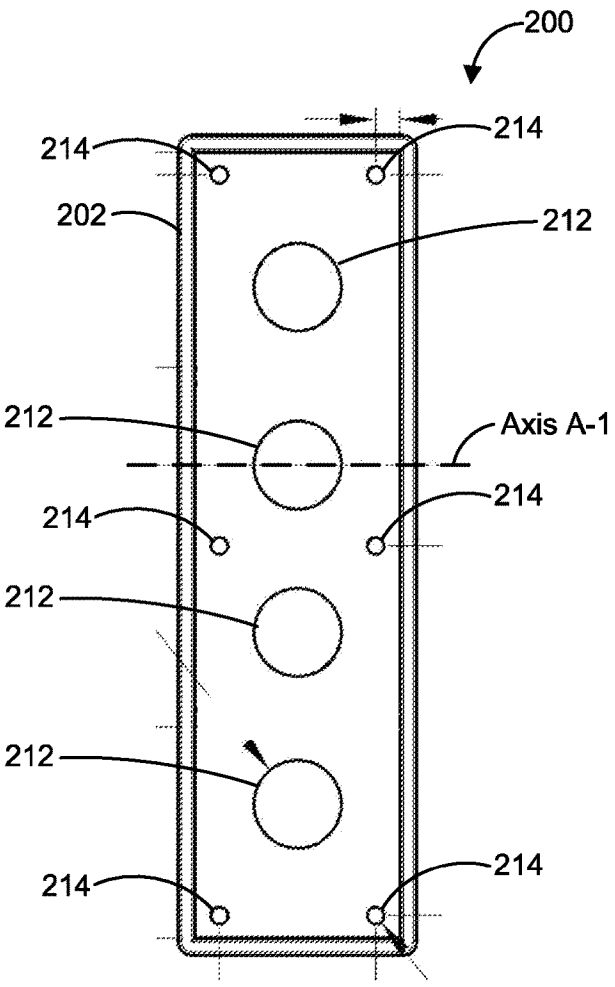
FIGS. 3A and 3B show a perspective view and a plan view, respectively, of a rear portion of the embodiment of the button station cover of FIG. 2.
Figure 3A:
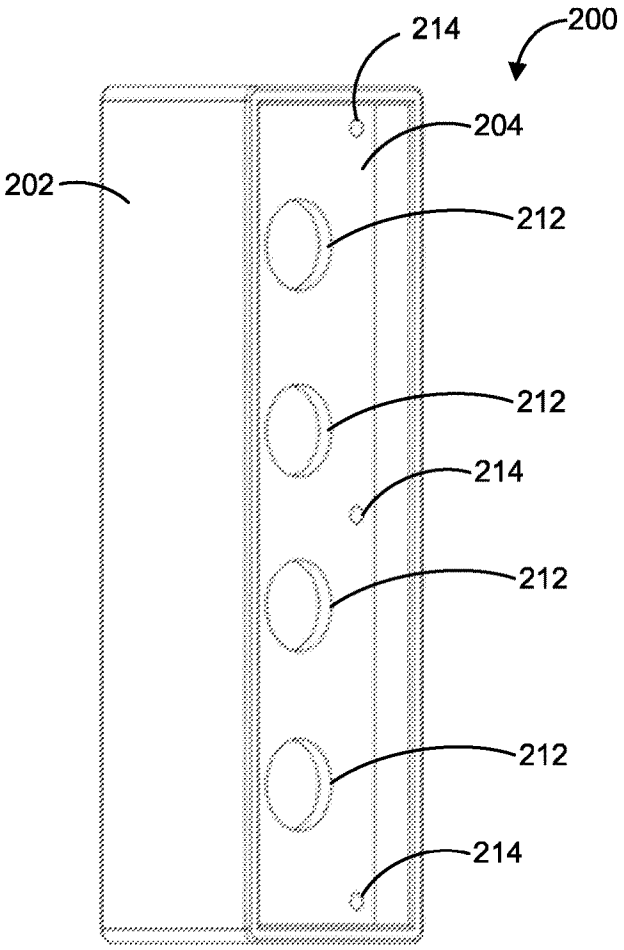

FIGS. 2A and 2B is a perspective view (FIG. 2A) and a plan view (FIG. 2B) of a front portion of an embodiment of button station cover 200. FIGS. 3A and 3B show a perspective view (FIG. 3A) and a plan view (FIG. 3B) of a rear portion of the button cover 200. As discussed more fully below, the button cover 200 is removably securable to the button station 100 to provide mechanical protection for the various controls 110, 112, and 114. The button cover 200 can be fabricated using any suitable rigid material capable of withstanding physical impact known to a person skilled in the art, including plastics, composite materials (such as fiberglass), and the like. In one embodiment, the button cover may be 3D printed using Ultem® polyetherimide plastic. In other embodiments, the button cover 200 can be fabricated using other plastics or materials according to various techniques known to those in the art, including injection molding.

The button cover 200 includes a sleeve 202 with a first and second open end 230 and 232 (see, for example, FIG. 4A), respectively, that define an interior space therebetween. In the illustrated embodiment, the geometry of the sleeve 202 is configured to surround or otherwise cover the button panel 104 as well as a portion of the housing 102 made up of the sidewalls 108 of the embodiment of the button station 100 of FIG. 1. In the illustrated embodiment, the sleeve 202 is rectangular with a longer longitudinal axis 220 and a shorter transverse axis 222, that latter axis running along the front and rear portions of the button cover 200 (i.e., traverses through the two open ends 230, 232). In other embodiments, the sleeve 202 of the button cover 200 may have other shapes or geometries to match the corresponding shapes or geometries of the button station in use. The thickness of the sleeve may be selected based on the material that is used for its fabrication. For example, if the material is Ultem® plastic, a thickness of between 1/16 inch to 1/4 inch or between 1.5875 mm to 6.35 mm may be suitable for providing the desired structural strength.

Figure 4B:
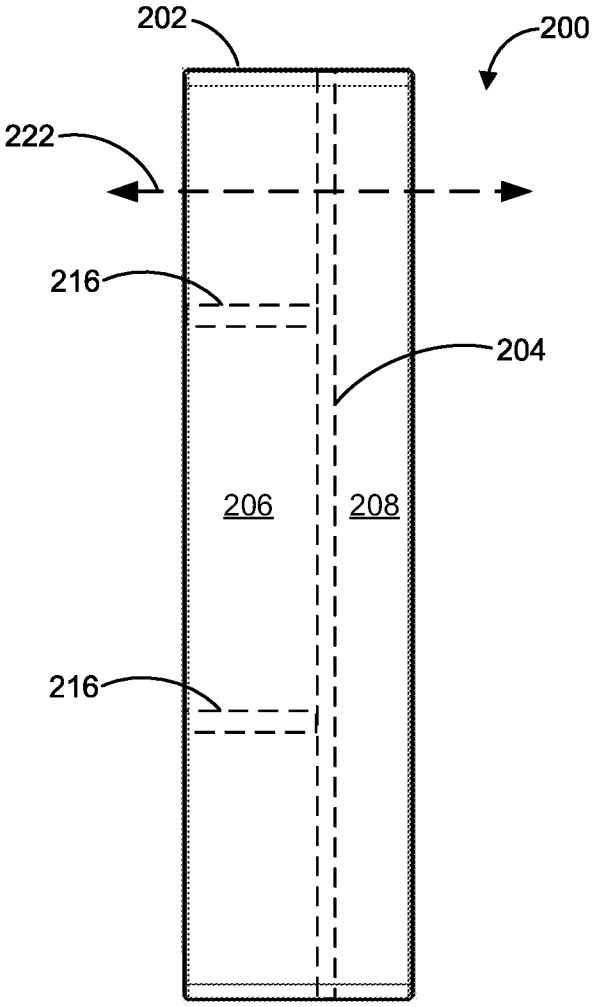
FIG. 4B is a side view of the embodiment of the button station cover of FIG. 2.
Figure 4A:
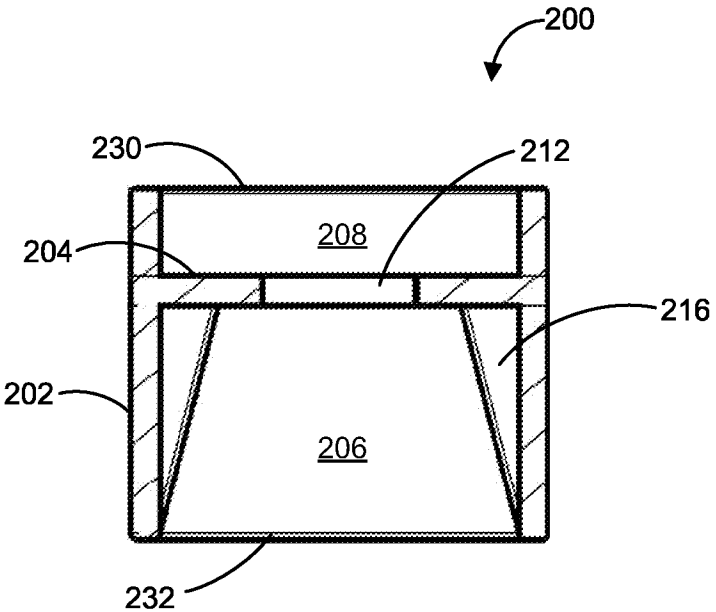
FIG. 4A is a cross-sectional view of the embodiment of the button station cover of FIG. 2 along axis A-1 as shown in FIGS. 2B and 3B.

Within the interior space of the sleeve 202, there is a dividing wall 204 positioned between the two openings 230 and 232, which divides the space surrounded by the sleeve 202 into two recesses, a front recess 206 and rear recess 208, as more clearly depicted in the cross-sectional view along axis A-1 in FIG. 4A. The dividing wall 204 as shown may be in contact with the inner surface 210 of the sleeve 202 and defines the depths of the front and rear recesses 206 and 208 based on its position along the transverse axis 222. In the illustrated embodiment, rear recess 208 is adapted to receive or otherwise engage button housing 102 when button cover 200 is installed over button station 100.

Figure 5B:
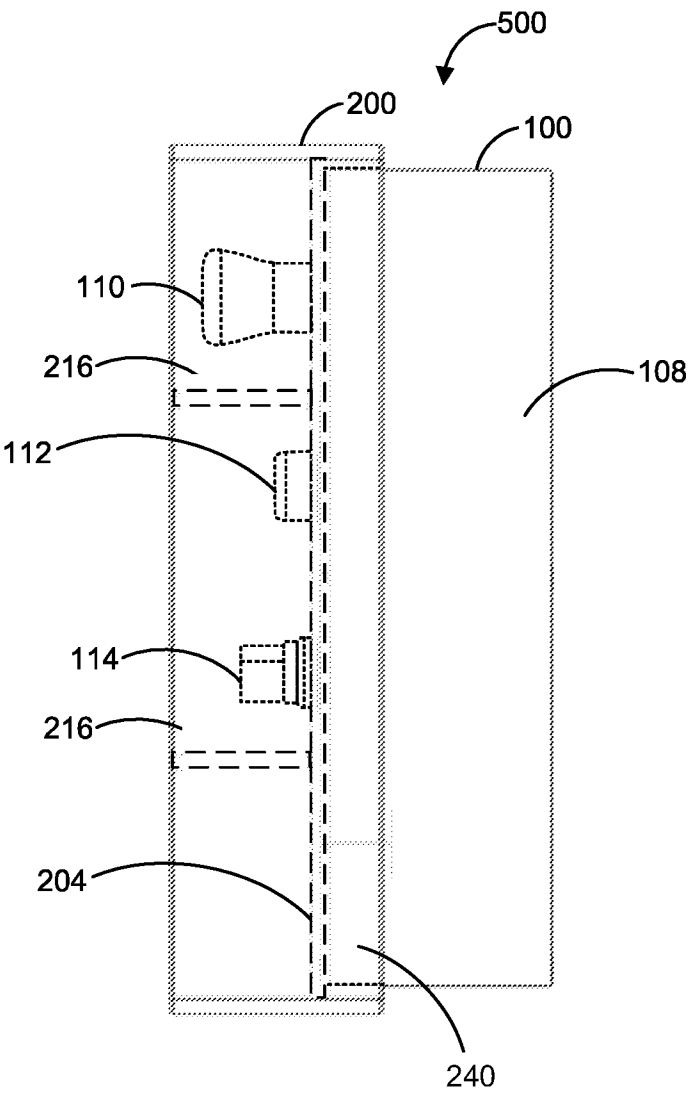
FIGS. 5A and 5B show a perspective view and a side view, respectively, of an assembly comprising the embodiment of the button station cover of FIG. 2 installed over the button station of FIG. 1.
Figure 5A:
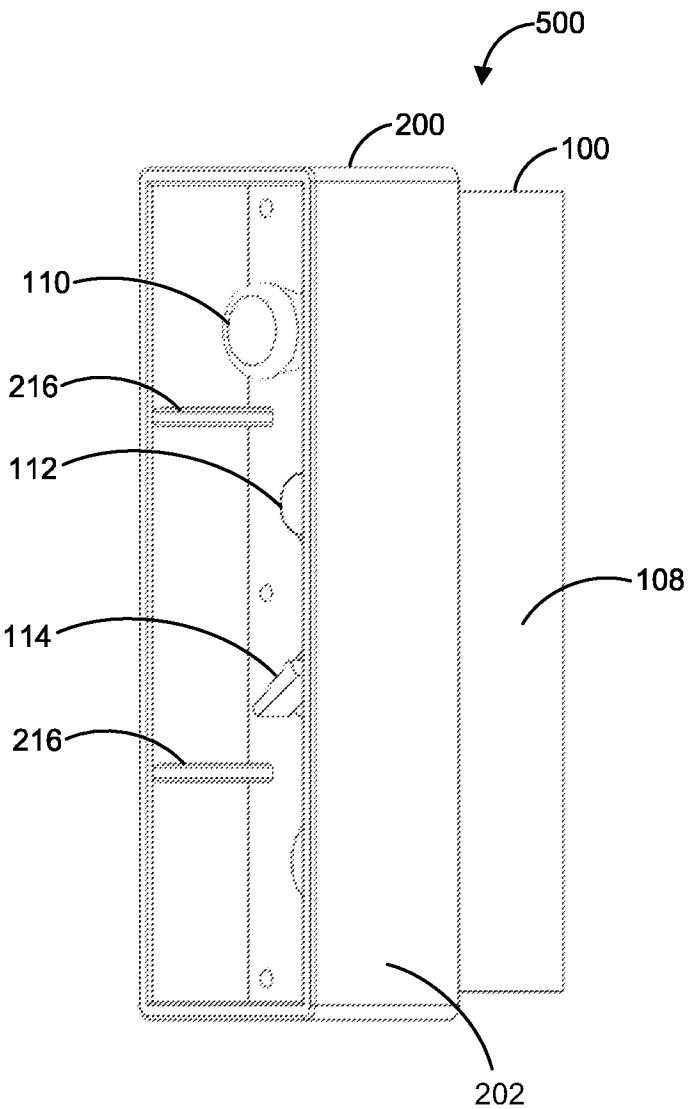

The dividing wall 204 includes a plurality of holes 212 that allow the controls 110, 112, and 114 to extend through the dividing wall 204 when the button cover 200 is installed on the button station 100, as shown in FIG. 5A. In the illustrated embodiment, the dividing wall 204 and the sleeve 202 are integrally formed with each other. In other embodiments, the dividing wall 204 and the sleeve 202 may be removably couplable to each other. In some embodiments, the sleeve 202 and dividing wall 204 can be 3D printed to enable the components to be integrally connected. For example, if the printing material is Ultem® plastic, the inventors have found that a thickness of between 1/16 inch to 1/4 inch or between 1.5875 mm to 6.35 mm to be suitable for sleeve 202 and dividing wall 204. In some embodiments, the dividing wall 204 may be attached using various methods known to those in the art, depending on the type of material used. For instance, the sleeve 202 and dividing wall 204 can be fabricated as separate plastic components and attached using bonding or fastening techniques like mechanical fastening, solvent bonding, vibration welding and induction welding.

The dividing wall 204 further includes an attachment mechanism to enable the button cover 200 to be secured to the button station 100. In the illustrated embodiment, a number of attachment holes 214 (see, for example, FIG. 2B) are provided to allow button cover 200 to be fastened to the button station 100. In the illustrated embodiment, each attachment hole 214 is positioned to align with the fastener holes 106 of the button panel 104. A suitable fastener, such as a screw, bolt, or the like, can be used to fasten button cover 200 to the button panel 104, and the button panel 104 can be secured to the housing 102. However, other attachment mechanisms known to a person skilled in the art can be used, including an adhesive and/or the like.

In the illustrated embodiment, the dividing wall 204 is positioned off-centre along the transverse axis 222 between the two open ends 230 and 232 of the sleeve 202 as shown in FIG. 4B, which results in the front recess 206 being deeper than the rear recess 208. In other embodiments, the dividing wall 204 may be position equidistant between the two open ends 230 and 232 of the sleeve 202 so that both the front recess 206 and rear recesses 208 have the same depth. In some embodiments, the dividing wall 204 is positioned off-centre so that the rear recess 208 is deeper than the front recess 206. Generally, the depth of the front recess 206 may be chosen so that it is at least (or exceeds) the length of the longest button that extends into the front recess 206 (see, for example, E-stop button 110 as shown in FIGS. 5A and 5B). In such a configuration, the sleeve 202 may be effective as a shield or guard to prevent accidental activation/actuation of the controls 110, 112, and 114.

In some embodiments, the front recess 206 optionally includes a plurality of support ridges 216. Support ridges 216 may extend from the dividing wall 204 and inner surface 210 of the sleeve 202 as shown in FIG. 2A. The support ridges 216 can provide additional strength and rigidity to the button cover 200. The support ridges 216 are not necessary to the functioning of the button cover 200. Where support ridges 216 are incorporated, the inventors have found that a slope having a rise:run ratio of 4:1 to be suitable for use (where the "rise" is along the depth of the front recess 206 along the transverse axis 222 of the sleeve 202 and the "run" is along the width of the dividing wall 204). However, other slopes (i.e., different rise:run ratios) can be used. Generally the thickness (i.e., measured along longitudinal axis 220) of the ridges 216 can vary depending on the strength of the material used. A weaker material may require a thicker ridge, and conversely, a stronger material means that a thinner ridge can be used. In some embodiments, the ridges 216 may have a thickness ranging from 1/16 inch to 1/4 inch or from 1.5875 mm to 6.35 mm.

FIGS. 5A and 5B show a perspective view (FIG. 5A) and a side view (FIG. 5B) of an embodiment of an assembly 500 comprising the button cover 200 installed over the button station 100. The front recess 206 of the button cover 200 is occupied by the various controls 110, 112, and 114. That is, controls 110, 112, and 114 extend through corresponding holes 212 when button cover 200 is installed over button station 100. When button cover 200 is installed over button station 100, the portion of the sleeve 202 surrounding the front recess 206 shields or guards the controls from accidental actuation/activation.

The rear recess 208 of the button cover 200 receives a portion of the housing 102 containing the button panel 104 so that the sleeve 202 surrounds/encloses a portion of sidewalls 108. The surface of the button panel 104 meets or comes into contact with the dividing wall 204 as shown in FIG. 5B. In this arrangement, the button panel 104 is inside the rear recess 208 and allows a portion of the sidewalls 108 of the housing 102 to be surrounded by a portion of the sleeve 202. That is, the button cover 200 encases a portion of the button station 100, thereby defining an overlap region 240 as shown in FIG. 5B. The sleeve can be sized to achieve a relatively snug fit and to minimize any gaps formed between the sidewalls 108 and the portion of the inner surface 210 of the portion of sleeve 202 that surrounds the sidewalls 108.

Because of the sleeve's encasement of the sidewalls 108 of the housing 102, impact against the assembly 500 would therefore be sustained by the sleeve 202 of the button cover 200. As such, the force of impact is absorbed by the button cover 200 and/or redistributed away from the controls 110, 112, and 114 and applied to the sidewalls 108 and/or the button panel 104 of the housing 102 via the contact points created within the overlap region 240. The rear recess 208 can be designed to be sufficiently deep so that the desired redistribution of force can be obtained. For example, in the illustrated embodiment, an overlap region with a depth of at least 0.75 inch or 19.05 mm may be suitable to achieve the desired amount redistribution of force.

In some cases, the impact sustained by the button cover 200 may be so great that it results in damage. Advantageously, button cover 200 is designed to break away from the fasteners that hold the button cover 200 to the button station 100 and avoid disturbing the controls 110, 112, and 114 in most circumstances. The button cover 200 can be constructed in a way that it does not use controls 110, 112, and 114 to hold the assembly 500 in place. As previously noted, the button cover 200 can be removably fastened directly to button station 100 using fasteners known to a person skilled in the art, such as hold down bolts, through the attachment holes 214 and fastener holes 106. Button cover 200 can be designed to avoid contact with the controls 110, 112, and 114 of the button station 100. The button cover 200 can be designed to break away from the held down bolts if a large impact is to occur. If the button cover 200 breaks away, it would not stress controls 110, 112, and 114 as there is no connection. Such feature may be applied not only to controls 110, 112, and 114, but to any button station having any number of controls and configuration. Further, as noted above, the button cover 200 encloses or wraps around the button station 100. Accordingly, if the fasteners fail, the button cover 200 can still be held loosely in place by the snug fit between sleeve 202 and sidewall 108 (e.g., due to how a portion of sleeve 202 wraps around button station 100). This configuration can help to keep button cover 200 in place (e.g., by partially encasing button station 100) so that it does not shear the controls 110, 112, and 114 off in the direction it is struck. Damage to the button cover 200 rather than to the controls 110, 112, and 114 is preferable because the button cover 200 may be replaced without imposing any downtime to the system being controlled by the buttons and dials 110, 112, and 114 of the button station. Accordingly, use of the button cover 200 can minimize system downtime by reducing the likelihood of the controls 110, 112, and 114 from becoming damaged. Furthermore, the button cover 200 also serves to reduce the likelihood that the controls 110, 112, and 114 are unintentionally actuated/activated.

Figure 6B:
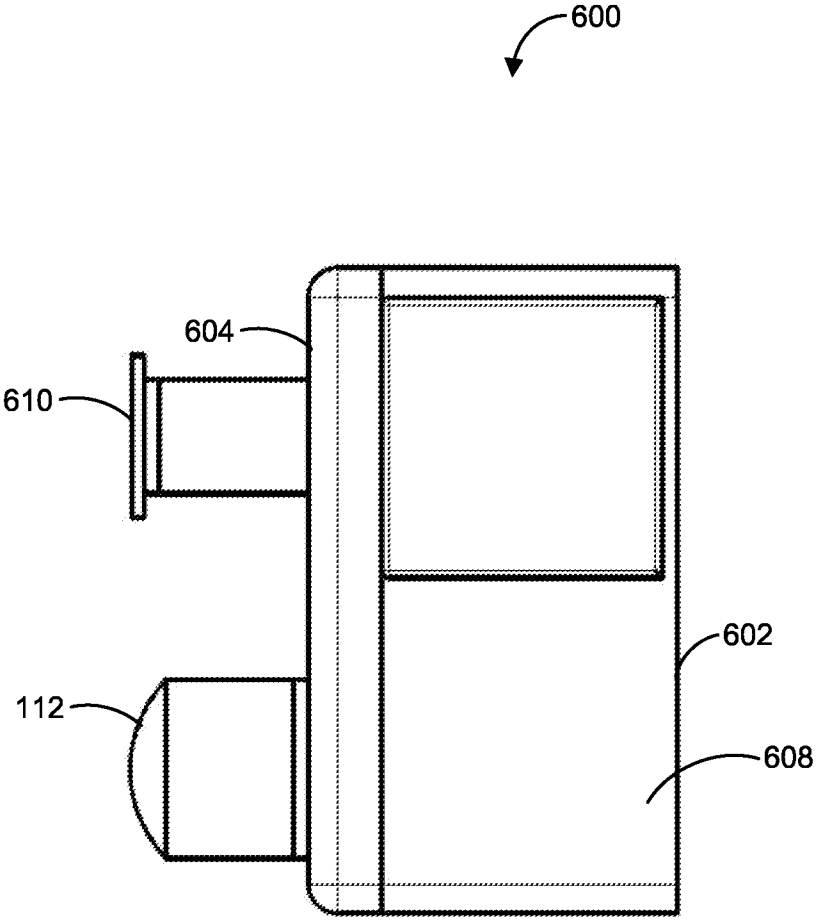
FIGS. 6A and 6B show a perspective view and a side view, respectively, of another example of a button station.
Figure 6A:
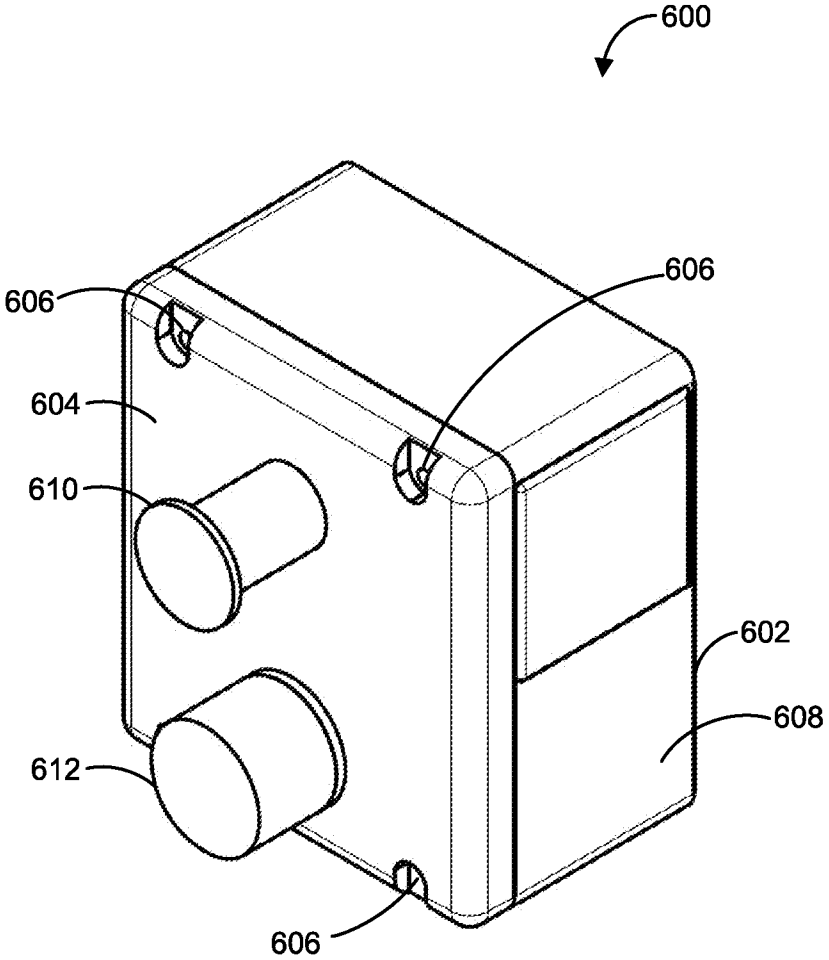

FIGS. 6A and 6B is a perspective view (FIG. 6A) and a side view (FIG. 6B) of another example of a button station 600. The button station 600 can be used as a component of a control system operable to control the operation of a mechanical system within an industrial environment.

Similar to the button station 100 illustrated in FIG. 1, the button station 600 includes a housing 602, which comprises a button panel 604 on which various buttons and indicators are installed, a rear panel (not shown), and sidewalls 608 positioned between the button panel 604 and the rear panel. The button panel 604 is removably coupled to the overall housing 602 to allow installation and wiring of the buttons and indicators within the button station 600. The button panel 604 includes a plurality of fastener holes 606 to receive fasteners to fasten the button panel 604 to the housing 602. In the illustrated embodiment, the housing 602 is generally square in shape, which provides a square shaped button panel 604. However, in other embodiments, the housing 602 and/or button panel 604 may have different shapes to suit the operating environment in which button station 600 is installed.

In the embodiment illustrated in FIGS. 6A and 6B, the button station 600 comprises an emergency stop (E-Stop) button 610 and a status indicator 612, the latter used to indicate whether the E-Stop button has been pressed or activated. The illustrated button station 600 can be used with any suitable E-Stop button system. In one embodiment, the E-stop button system is a pull wire emergency stop switch in the LineStrong' series of switches from equipment manufacturer ABB'. Such a button station 600 may be commonly found in industrial environments, such as production/assembly lines and warehouses and designed to be mounted on machines and sections of conveyors which cannot be protected by guards. The button station 600 is generally installed in a position that enables ease of access in case an emergency stop is required. The LineStrong™ switch can initiate an emergency stop command from any point along the installed wire length by actuating the E-stop button to provide emergency stop protection for exposed conveyors and machines. Given the positioning of the button station 600, the E-stop button 610 and indicator 612 are vulnerable to damage from accidental impact from various objects, such as pushcarts, pallet jacks, and the like.

Like button station 100, button station 600 may include any suitable number and/or any suitable combination of controls (e.g., including the controls shown in FIGS. 1A and 1B), actuators, indicators, etc.

Figure 7B:
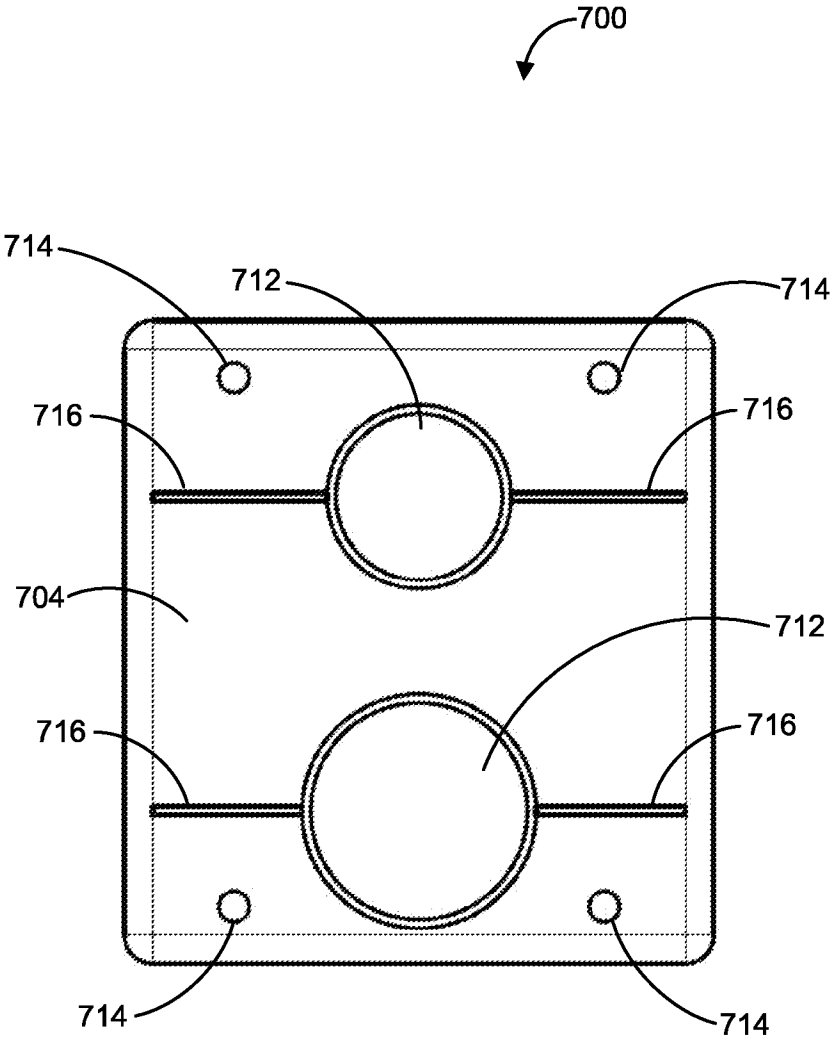
FIGS. 7A and 7B show a perspective view and a plan view, respectively, of a front portion of a second embodiment of the button station cover.
Figure 7A:
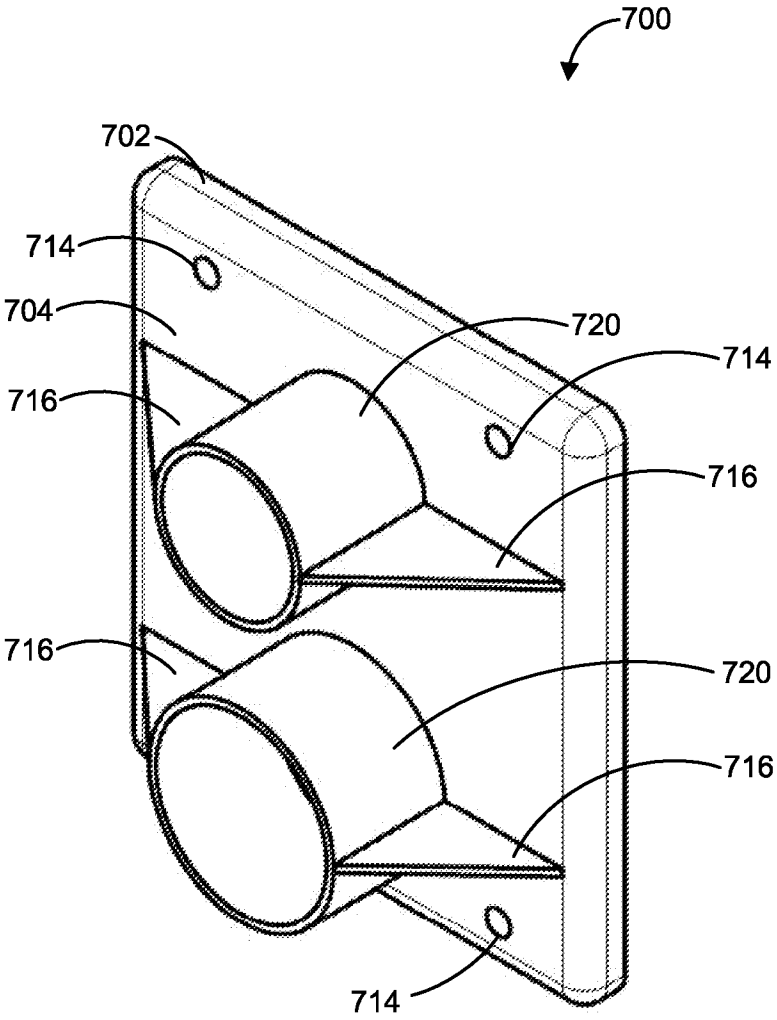

FIGS. 7A and 7B is a perspective view (FIG. 7A) and a plan view (FIG. 7B) of a front portion of an embodiment of button station cover 700. As discussed more fully below, the button cover 700 is removably securable to the button station 600 to provide mechanical protection for the E-stop button 610 and indicator 612. The button cover 700 can be fabricated using any suitable rigid material capable of withstanding physical impact known to a person skilled in the art, including plastics, composite materials (such as fiberglass), and the like. In one embodiment, the button cover 700 may be 3D printed using Ultem® polyetherimide plastic. In other embodiments, the button cover 700 can be fabricated using other plastics or materials according to various techniques known to those in the art, including injection molding.

The button cover 700 includes a sleeve 702 (illustrated more clearly in FIGS. 8A and 8B) with a first and second open end (not shown) similar to the sleeve 202 of FIG. 2A that defines an interior space. The thickness of the sleeve 702 may be selected based on the material that is used for its fabrication. For example, if the material is Ultem® plastic, a thickness of from 1/16 inch to 1/4 inch or from 1.5875 mm to 6.35 mm may be suitable for obtaining the desired structural strength.

In the illustrated embodiment, a panel 704 is positioned at one of the open ends of the sleeve 702 so that the interior space surrounded by the sleeve 702 and the panel 704 forms a recess (not shown). In the illustrated embodiment, the recess is intended to receive the button panel 604 as well as a portion of the housing 602 made up of the sidewalls 608 of the embodiment of the button station 600 of FIG. 6. This configuration can be regarded as an alternative to the button cover 200 of FIG. 2, where the dividing wall 204 is positioned at or close to the first opening 232 so that the interior space surrounded by the sleeve 202 is substantially or completely allocated to the rear recess 208 for receiving the button station 100.

Figure 9B:
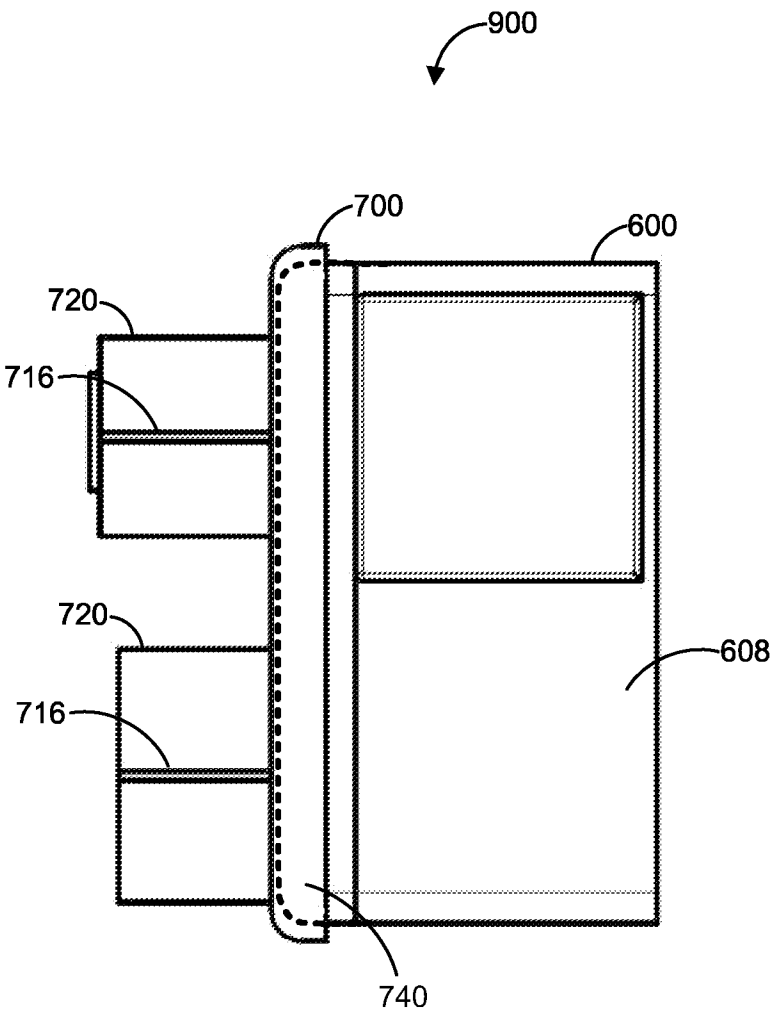
FIGS. 9A and 9B show a perspective view and a side view, respectively, of an assembly comprising the embodiment of the button station cover of FIG. 7 installed over the button station of FIG. 6.
Figure 9A:
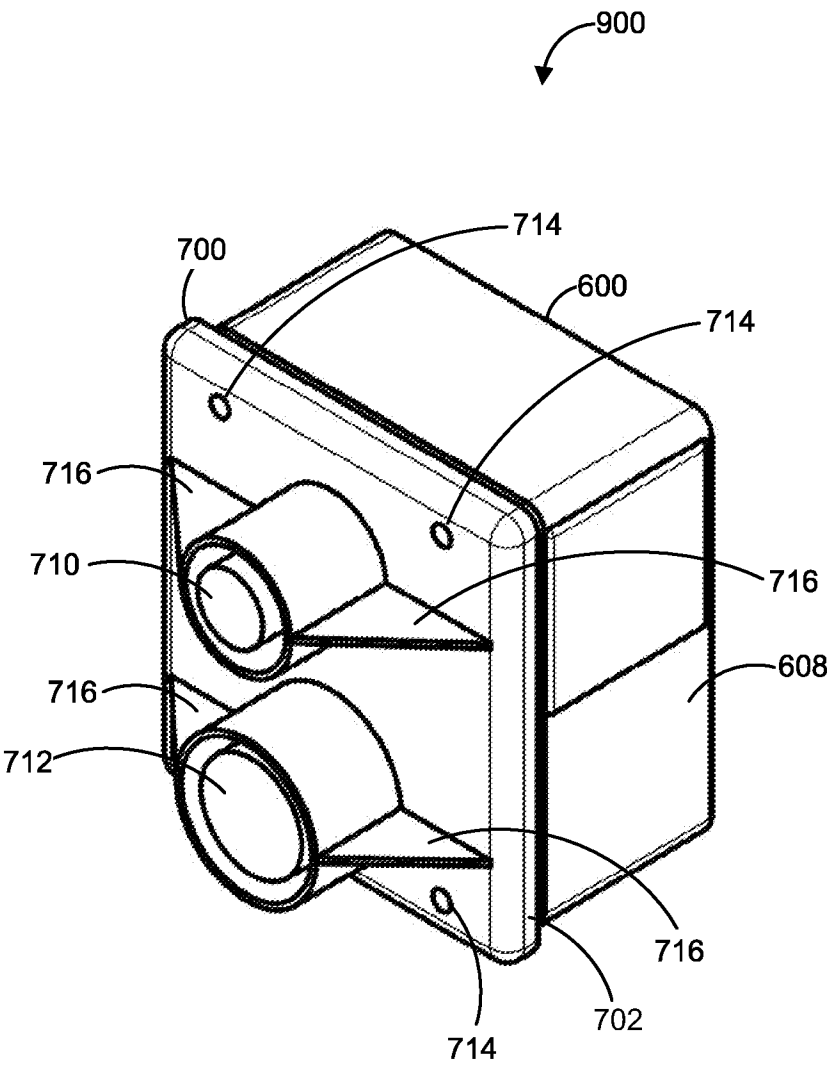

As shown in FIG. 7B, the panel 704 includes holes 712 to allow the E-stop button 610 and indicator 612, or the like, to extend through the panel 704 when the button cover 700 is installed on the button station 600, as shown in FIG. 9A. In the illustrated embodiment, the panel 704 and the sleeve 702 of the present embodiment are integrally formed with each other. In other embodiments, the panel 704 and the sleeve 702 may be removably couplable to each other. In some embodiments, the sleeve 702 and panel 704 can be 3D printed to enable the components to be integrally connected. For example, if the printing material is Ultem® plastic, the inventors have found that a thickness of from 1/16 inch to 1/4 inch or from 1.5875 mm to 6.35 mm may be suitable for sleeve 702 and panel 204. In some embodiments, the panel 704 may be attached using various methods known to those in the art, depending on the type of material used as noted previously.

The panel 704 further includes an attachment mechanism to enable the button cover 700 to be secured to the button station 600. In the illustrated embodiment, a number of attachment holes 714 (see, for example, FIG. 7B) are provided to allow button cover 700 to be fastened to the button station 600. In the illustrated embodiment, each attachment hole 714 is positioned to align with the fastener holes 606 of the button panel 604. A suitable fastener, such as a screw, bolt, or the like, can be used to fasten button cover 700 to the button panel 604, and the button panel 604 can be secured to the housing 602. However, other attachment mechanisms known to a person skilled in the art can be used, including an adhesive and the like.

In the illustrated embodiment, shields 720 extend from each hole 712 provided on the panel 704 and each shield 720 surrounds the corresponding E-stop button 610 and indicator 612, or the like, that extend through their respective hole 712. The space within each of the shields 720 can be regarded as a recess for receiving the respective E-stop button 610 and the indicator 612. Each shield 720 has an open end that exposes the E-stop button 610 and indicator 612, or the like, for actuation and/or visual observation, as applicable. These shields 720 guard the respective button 610 or indicator 612 from direct impact by an external object to reduce the chance of damage as well as prevent accidental activation or actuation of the E-stop button 610.

Figure 8B:
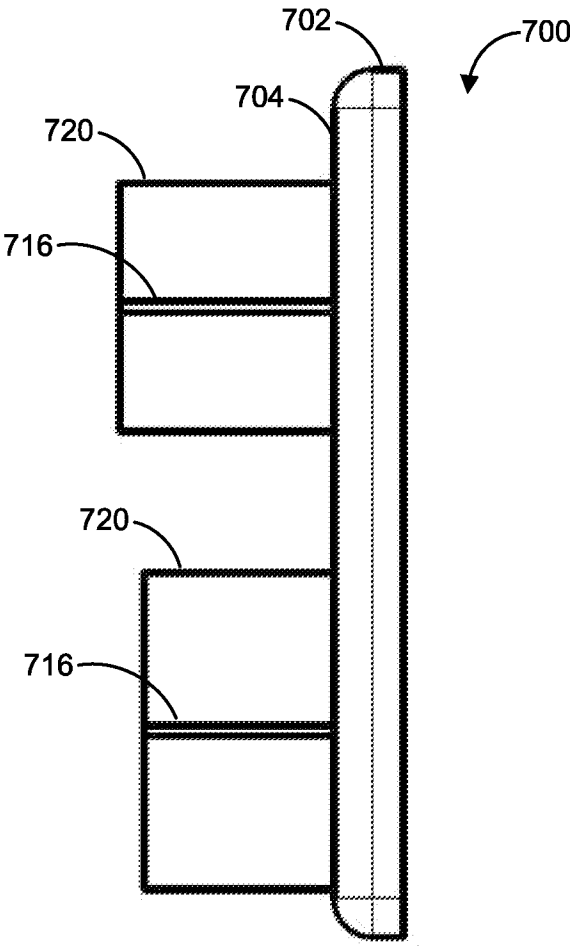
FIGS. 8A and 8B show a top view and a side view, respectively, of the embodiment of the button station cover of FIGS. 7.
Figure 8A:
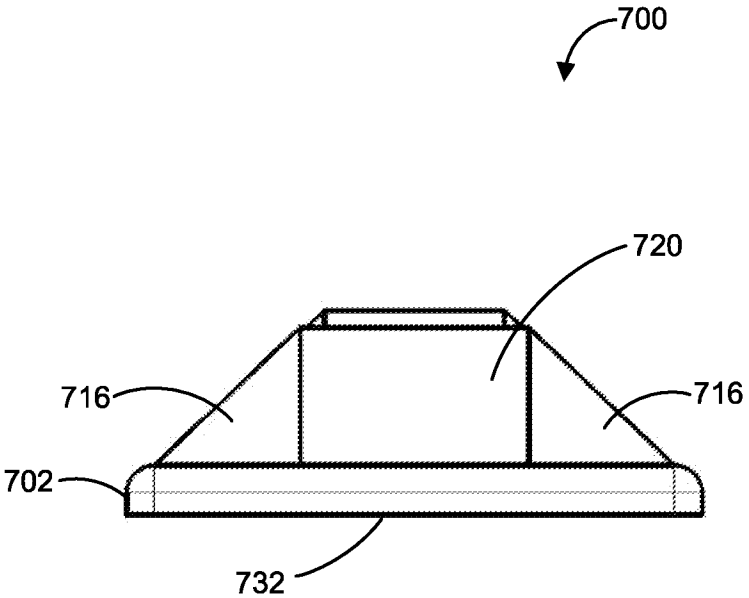

In the embodiment illustrated in FIGS. 7A and 8A, button cover 700 includes a pair of ribs 716 coupled to each shield 720. Each rib 716 extends from an exterior surface of shield 720 to a corresponding surface of the panel 704 as shown in FIGS. 7A and 8A. The ribs 716 in the illustrated embodiment is planar and can provide additional protection by acting as a first point of contact to buffer and deflect incoming objects from the shields 720. In the illustrated embodiment, each pair of ribs 716 is oriented along the same plane as shown in FIG. 7B as well as in an orientation that is expected to maximize interception of incoming objects. For example, where the button station 600 is generally installed in a manner so that the E-stop button 610 and indicator 612 are oriented vertically relative to the ground, the ribs 716 can be oriented horizontally relative to the ground (i.e., along a plane parallel to the ground). This orientation can maximize interception of incoming objects by the ribs 716, such as pushcarts, because such carts and other similar objects/vehicles that move around in a warehouse or industrial environment move along the ground horizontally. In some embodiments, the shields 720 are sized and shaped to fit the E-stop button 610 and indicator 612. The height of shields 720 is at least the length of the E-stop button 610 and/or indicator 12 or greater than such length. In some embodiments, the height of the various shields 720 of button cover 700 may be different from each other. For example, the upper shield 720 has a height of about 1.125 inches and the lower shield 720 has a height of about 1 inch in the illustrated embodiment. The inclusion of these ribs 716 may buffer or deflect incoming objects to further reduce the risk of damaging E-stop button 610 and indicator 612 and help reinforce or increase the overall strength of the button cover 700. Ribs 716 can strengthen shield 720 while deflecting impact away from it. Without ribs 716, shield 720 can be impacted at a 90 degree angle. Ribs 716 provide a deflecting angle while removing catch points. In some embodiments, the deflecting angle is at or around 45°. When describing the "rise" and "run" of ribs 716, the "rise" of ribs 716 is the length of ribs 716 along the depth of the side of the shield 720 and the "run" is the length of ribs 716 along the width of panel 704 as shown in FIGS. 8A and 8B. In some embodiments, the rise of ribs 716 matches the height of the applicable shield 720. For example, if the applicable shield 720 has a height of 1 inch, then the rise of the ribs will be 1 inch. In some embodiments, the run of ribs 716 is designed in accordance with the diameter of the applicable shield 720. In some embodiments, the diameter of shield 720 and the run of rib 716 are designed based on the size and/or design of the button protected by shield 720. In some embodiments, the outside diameter of upper shield 720 is about 1.43 inches and the applicable run of upper rib 716 is about 1.24 inches. In some embodiments, the outside diameter of lower shield 720 is about 1.75 inches and the applicable run of lower rib 716 is about 1.07 inches. In some embodiments, the ribs 716 may have a thickness ranging from 1/16 to 1/4 inch or from 1.5875 to 6.35 mm.

FIGS. 9A and 9B show a perspective view (FIG. 9A) and a side view (FIG. 9B) of an embodiment of an assembly 900 comprising the button cover 700 installed over the button station 600. The volume of space within the shields 720 of the button cover 700 is occupied by the respective E-stop button 610 and indicator 612.

The recess (not shown) located behind the panel 704 of the button cover 700 and surrounded by the sleeve 702 receives a portion of the housing 602 containing the button panel 604 so that the sleeve 702 surrounds/encloses a portion of sidewalls 608. As shown in FIG. 9B, the surface of the button panel 604, depicted using dashed lines, meets or comes into contact with the rear side of the panel 704. In this arrangement, the button panel 604 is inside the recess and allows a portion of the sidewalls 608 of the housing 602 to be surrounded by the sleeve 702. That is, the button cover 700 encases a portion of the button station 600 to define an overlap region 740 as shown in FIG. 5B. The sleeve 702 can be sized to achieve a relatively snug fit and to minimize any gaps formed between the sidewalls 608 and an inner surface (not shown) of the sleeve 702 the surrounds the sidewalls 708.

Because of the sleeve's 702 encasement of the sidewalls 608 of the housing 602, impact against the assembly 900 would therefore be largely sustained by the button cover 700 including one or more of the sleeve 702, ribs 716, and shields 720. As such, the force of impact is absorbed by the by the button cover 700 and/or redistributed away from E-stop button 610 and indicator 612 and applied to the sidewalls 608 and/or the button panel 604 of the housing 602 via the contact points created within the overlap region 740. For example, in the illustrated embodiment, sleeve 702 has a depth of at least 0.3 inch or 7.62 mm. Such depths may be suitable to achieve the desired amount redistribution of force. In the absence of encasement 702, button cover 700 would be subject to a direct 90 degree impact which would cause the entire assembly 900 to fail.

Unless the context clearly requires otherwise, throughout the description and the claims: "comprise," "comprising," and the like are to be construed in an inclusive sense, as opposed to an exclusive or exhaustive sense; that is to say, in the sense of "including, but not limited to". "Connected," "coupled," or any variant thereof, means any connection or coupling, either direct or indirect, between two or more elements; the coupling or connection between the elements can be physical, logical, or a combination thereof. "Herein," "above," "below," and words of similar import, when used to describe this specification shall refer to this specification as a whole and not to any particular portions of this specification. "Or" in reference to a list of two or more items, covers all of the following interpretations of the word: any of the items in the list, all of the items in the list, and any combination of the items in the list. The singular forms "a," "an," and "the" also include the meaning of any appropriate plural forms.

Words that indicate directions such as "vertical," "transverse", "horizontal," "upward," "downward," "forward," "backward," "inward," "outward", "vertical," "transverse," "left," "right," "front," "back", "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component is referred to above, unless otherwise indicated, reference to that component (including a reference to a "means") should be interpreted as including as equivalents of that component, any component which performs the function of the described component (i.e., that is functionally equivalent), including components which are not structurally equivalent to the disclosed structure which performs the function in the illustrated exemplary embodiments of the invention.

Specific examples of systems, methods and apparatuses have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

The invention claimed is:

1. A button cover for covering a button station having one or more buttons, the button cover comprising:

a button cover sleeve with a first open end and a second open end, the first open end and the second open end defining an interior space therebetween;

a dividing wall provided within the interior space between the first open end and the second open end, the dividing wall separating the interior space into a first recess and a second recess; and at least one opening defined on the dividing wall to permit a corresponding button of the button station to extend from the first recess through the opening into the second recess when the button cover is installed over the button station, wherein a portion of the button cover sleeve defining the first recess is shaped to surround a button panel and a corresponding portion of a button housing on which the button is installed when the button cover is installed over the button station to thereby define an overlap region between the button cover and the portion of the button housing.

2. The button cover of claim 1, wherein the portion of the button housing is received in the first recess and wherein the button panel meets with the dividing wall.

3. The button cover of claim 1, wherein the button cover sleeve is configured to cause external forces applied against the button to be sustained by the button cover sleeve when the button cover is installed over the button station such that the external forces are redistributed away from the button to the button panel and the button housing via the overlap region.

4. The button cover of claim 1, wherein the first recess has a first depth that is greater than a second depth of the second recess.

5. The button cover of claim 1, wherein the first recess has a first depth that is the same as a second depth of the second recess.

6. The button cover of claim 1, wherein the first recess has a first depth that is less than a second depth of the second recess.

7. The button cover of claim 1, wherein the second recess has a second depth that is at least a length of the button of the button station.

8. The button cover of claim 1, wherein the button cover sleeve and dividing wall are fabricated using a rigid material.

9. The button cover of claim 1 comprising a plurality of support ridges located within the second recess, each of the plurality of ridges extending from a corresponding location on the dividing wall to an internal surface of the button cover sleeve.

10. The button cover of claim 9, wherein each of the plurality of support ridges has a slope having a rise:run ratio of about 4:1.

11. A button cover for covering a button station having one or more buttons, the button cover comprising:

a button cover sleeve with a first open end and a second open end; a panel provided at the first open end of the button cover sleeve, the panel and the button cover sleeve defining a recess for engagement with a button housing of the button station;

at least one opening defined on the panel to permit a corresponding button of the button station to extend therethrough when the button cover is installed over the button station; and a shield disposed around each of the at least one opening, the shield extending away from the recess, wherein a portion of the button cover sleeve is shaped to surround a button panel and a corresponding portion of the button housing on which the button is installed when the button cover is installed over the button station to thereby define an overlap region between the button cover and the portion of the button housing.

12. The button cover of claim 11, wherein the portion of the button housing is received in the recess and wherein the button panel meets with the panel.

13. The button cover of claim 11, wherein the button cover sleeve is configured to cause external forces applied against the button to be sustained by the button cover sleeve when the button cover is installed over the button station such that the external forces are redistributed away from the button to the button panel and the button housing via the overlap region.

14. The button cover of claim 11, wherein the button cover sleeve and panel are fabricated using a rigid material.

15. The button cover of claim 11, wherein the shield has a length that is greater than or equal to a button length of the button of the button station.

16. The button cover of claim 11, comprising a pair of ribs, wherein each rib extends from an exterior surface of the shield to the panel.

17. The button cover of claim 16, wherein the pair of ribs are positioned on a common plane parallel to a top surface of the button cover.

* * * * *